US006890199B2

(12) United States Patent
Vogt et al.

(10) Patent No.: US 6,890,199 B2
(45) Date of Patent: May 10, 2005

(54) BIPIN LAMP SOCKET

(75) Inventors: Karl-Wilhelm Vogt, Ense (DE); Hartmut Greschner, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 10/788,671

(22) Filed: Feb. 26, 2004

(65) Prior Publication Data

US 2004/0219814 A1 Nov. 4, 2004

(30) Foreign Application Priority Data

Apr. 29, 2003 (DE) ..... 103 19 431

(51) Int. Cl.[7] ..... H01R 33/02
(52) U.S. Cl. ..... 439/238; 439/226; 439/362
(58) Field of Search ..... 439/220, 226, 439/233, 234, 232, 238, 242, 240, 356; 362/269, 226, 448, 441

(56) References Cited

U.S. PATENT DOCUMENTS 3,896,334 A * 7/1975 Rodriguez ..... 439/642
4,101,956 A * 7/1978 Crane ..... 362/217
4,565,431 A * 1/1986 Henley et al. ..... 396/185
5,855,487 A * 1/1999 Kunishi ..... 439/232
6,488,510 B2 * 12/2002 Li ..... 439/13
6,648,494 B2 * 11/2003 Sugimoto et al. ..... 362/524

FOREIGN PATENT DOCUMENTS

DE 38 26 298 6/1989
DE 94 09 147 11/1994

* cited by examiner

*Primary Examiner*—Briggitte R. Hammond
(74) *Attorney, Agent, or Firm*—Herbert Dubno; Andrew Wilford

(57) ABSTRACT

A socket for a bipin lamp has a relatively stationary body, a pair of contacts in the body symmetrically flanking an axis of the body, and a rotor formed with an axially open and generally diametrally extending slot and pivotal on the body about the axis between an outwardly open position and a crosswise position. Pins of the lamp are insertable into the slot and engageable with the contacts in the crosswise position. An operating part has a disk fixed to the rotor and formed with a slot aligned axially with the rotor slot and an arm fixed on and projecting radially from the disk past the lamp when the pins are in the slots. Thus a user can fit the lamp pins to the slots and pivot the rotor between the positions by the arm to engage the pins with the contacts.

8 Claims, 3 Drawing Sheets

BIPIN LAMP SOCKET

FIELD OF THE INVENTION

The present invention relates to a bipin lamp socket. More particularly this invention concerns such a socket used in axially aligned pairs normally for long fluorescent lamps.

BACKGROUND OF THE INVENTION

A standard bipin lamp, typically fluorescent, is fitted to a fixture having a pair of confronting, identical, and axially aligned sockets which each have a seat into which the two pins can be slid, and a pair of contacts that engage the respective pins when the lamp is properly seated. In order to hold the lamp in place, it is necessary to provide some structure that actually grips the contacts when the lamp is fitted properly in place or that captures the pins.

In a standard system, each socket is formed with a basically triangular and outwardly open slot. The two pins are aligned with a narrow mouth of the slot and pushed into it, then the lamp is rotated through about 90° so that the two pins move outward to press against the contacts that flank the slot and that are somewhat springy to press elastically against and hold the lamp. This is the simplest system and is only effective if the user can bet a good grip on the lamp so that it can be pivoted once it is fitted to the two sockets.

In many modern fixtures the lamp is, however, a very tight fit in the fixture so that there is really no room for the installer's fingers to engage around the lamp so as to be able to turn it. Thus as described in German utility model 94 09 147 published 10 Nov. 1994 it is known to provide a complex slide mechanism in each socket. The lamp is fitted to the slide mechanism and pressed inward, thereby actuating structure that engages and grips the lamp's pins. Such a system is fairly complex and adds considerably to the cost of the socket.

German patent 3,826,298 published 29 Jun. 1989 of Bushhoff describes another system where a sort of dielectric wrench is provided that is engaged with the lamp pins and that serves to pivot the lamp. Such an arrangement is inexpensive and highly effective, but requires that the user keep track of this wrench for installing and removing a lamp from the fixture. The wrench normally goes lost in the months or years between lamp changes, leaving the user with a nearly impossible job in getting out the old lamp and installing a new one.

OBJECTS OF THE INVENTION

It is therefore an object of the present invention to provide an improved bipin lamp socket.

Another object is the provision of such an improved bipin lamp socket which overcomes the above-given disadvantages, that is which is of simple and inexpensive construction.

SUMMARY OF THE INVENTION

A socket for a bipin lamp has a relatively stationary body, a pair of contacts in the body symmetrically flanking an axis of the body, and a rotor formed with an axially open and generally diametrally extending slot and pivotal on the body about the axis between an outwardly open position and a crosswise position. Pins of the lamp are insertable into the slot and engageable with the contacts in the crosswise position. According to the invention an operating part has a disk fixed to the rotor and formed with a slot aligned axially with the rotor slot and an arm fixed on and projecting radially from the disk past the lamp when the pins are in the slots. Thus a user can fit the lamp pins to the slots and pivot the rotor between the positions by the arm to engage the pins with the contacts.

With this system, therefore, the operating part is fixed to the socket so it cannot get lost. It makes it easy to pivot the lamp when installing it, even when the lamp is received with minimal clearance in the light fixture in which the sockets are mounted. What is more, the operating part can be retrofitted to an existing lamp socket, and in fact in a standard dual-socket system it is possible to provide only one such operating part on one of the sockets. The pivoting force is applied directly to the lamp pins which avoids the possibility of breaking off the pins as happens when the lamp is being rotated by a person gripping its glass tube.

According to the invention the disk and rotor have axially interengaging complementary formations that couple them together for joint rotation about the axis. These formations can include a pair of outwardly open holes formed in the rotor and flanking the rotor slot and a pair of axially extending pins formed on the disk flanking the rotor disk and fittable in the rotor holes. These rotor holes are aligned with the contacts so that, when the coupling pins are made tubular, a test probe can be inserted through to the rotor holes.

The rotor in accordance with the invention has an axially outwardly directed face and the disk has an axially inwardly directed face. These two faces can be bonded together, either by an adhesive or by welding. In addition axially extending complementary formations are provided on the faces to rotationally fix the disk to the rotor. The arm of the operating projects radially past the socket body.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
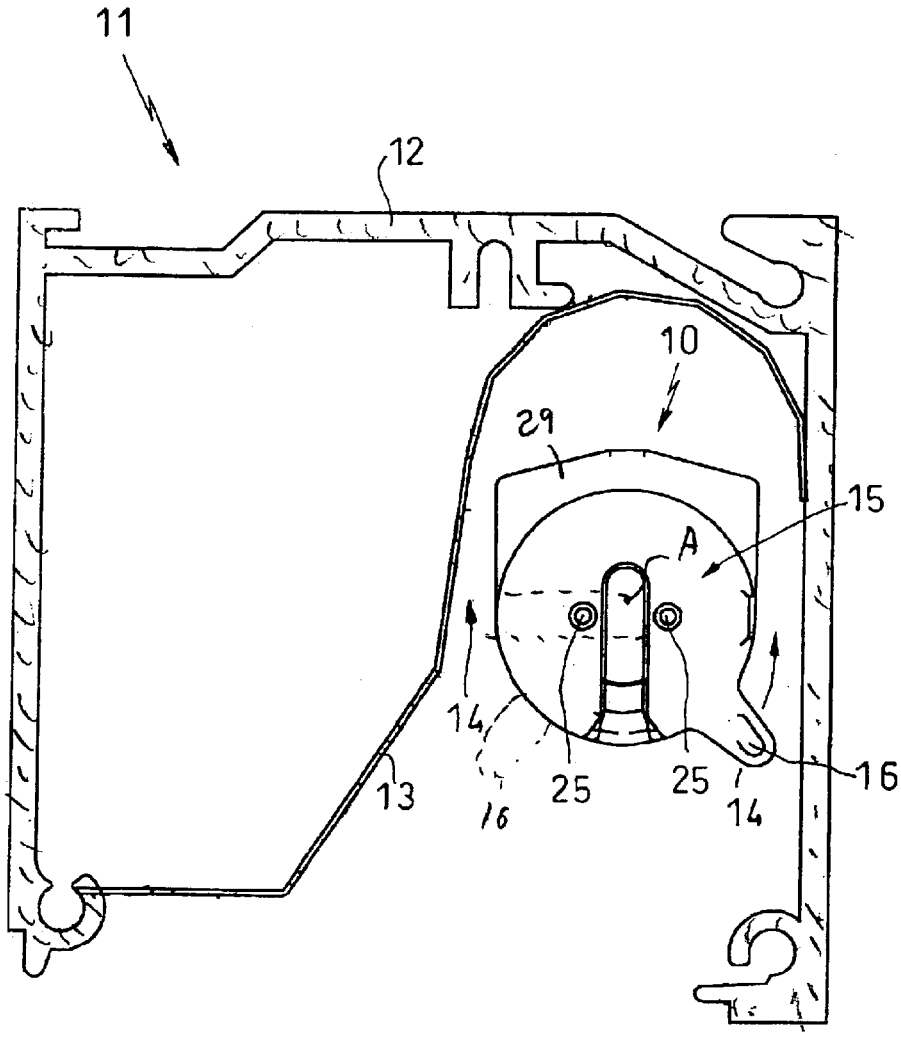
FIG. 1 is a cross section through a light fixture with a socket according to the invention.
Figure 2:
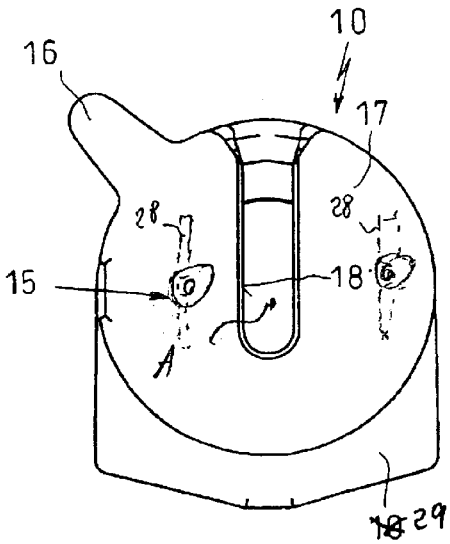
FIGS. 2, 3, and 4 are end, perspective, and exploded views of the socket in accordance with the invention.
Figure 4:
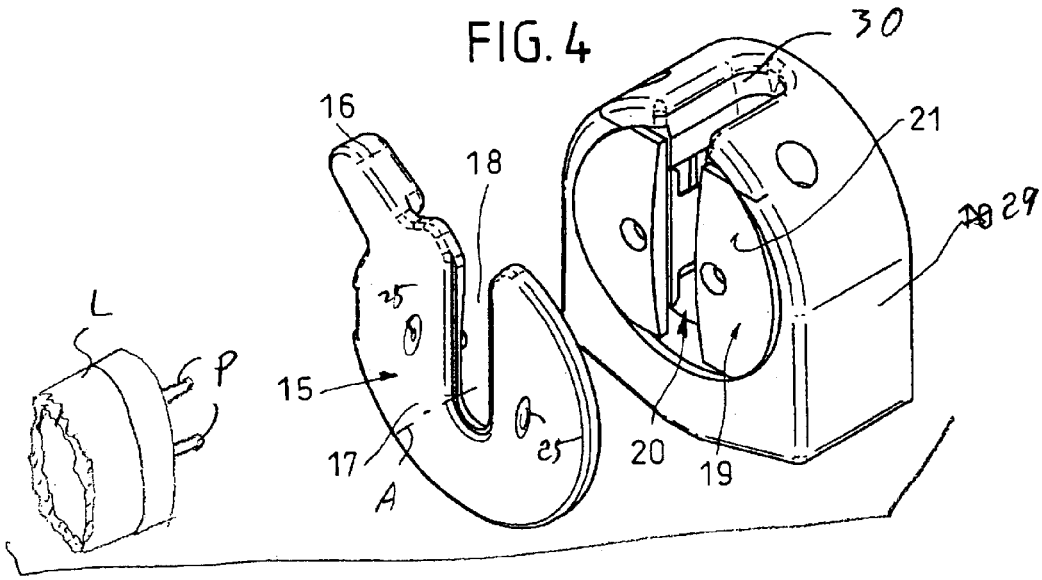

As seen in FIG. 1 a light fixture 11 according to the invention has an elongated extruded-aluminum housing 12 formed as a channel and holding an elongated reflector 13 defining a relatively narrow slot 14 extending along an axis A and holding a pair of substantially identical sockets 10 of which only one is shown. Such a fixture 11 is adapted to hold a standard bipin fluorescent lamp shown partially at L in FIG. 4 and having at each end a pair of axially projecting contact pins P.

Each socket 10 comprises a plastic body 29 that is fixed in a respective end of the fixture 11 and that holds a pair of contacts 28 symmetrically flanking the axis A and also normally flanking a vertical plane, presuming the fixture 11 is to be mounted in the downwardly open orientation of FIG. 1. The rotor 19 is formed with a crosswise slot 20 that can move between the open position shown in the drawing and a closed position 90° offset thereto. In the open position the slot 20 aligns with a slot 30 of the housing 29 and it is possible to slide the pins P of the lamp L into the rotor 19, but when the rotor 19 is pivoted into the closed position, these pins P engage and fit with the contacts 28 and the slots 20 and 30 are misaligned so the pins P are captured in the housing. In addition, the rotor 19 has a front face 21 formed in line with the contacts 28 with two holes 24 through which a test probe can be inserted to determine if the contacts 29 are live.

Figure 5:
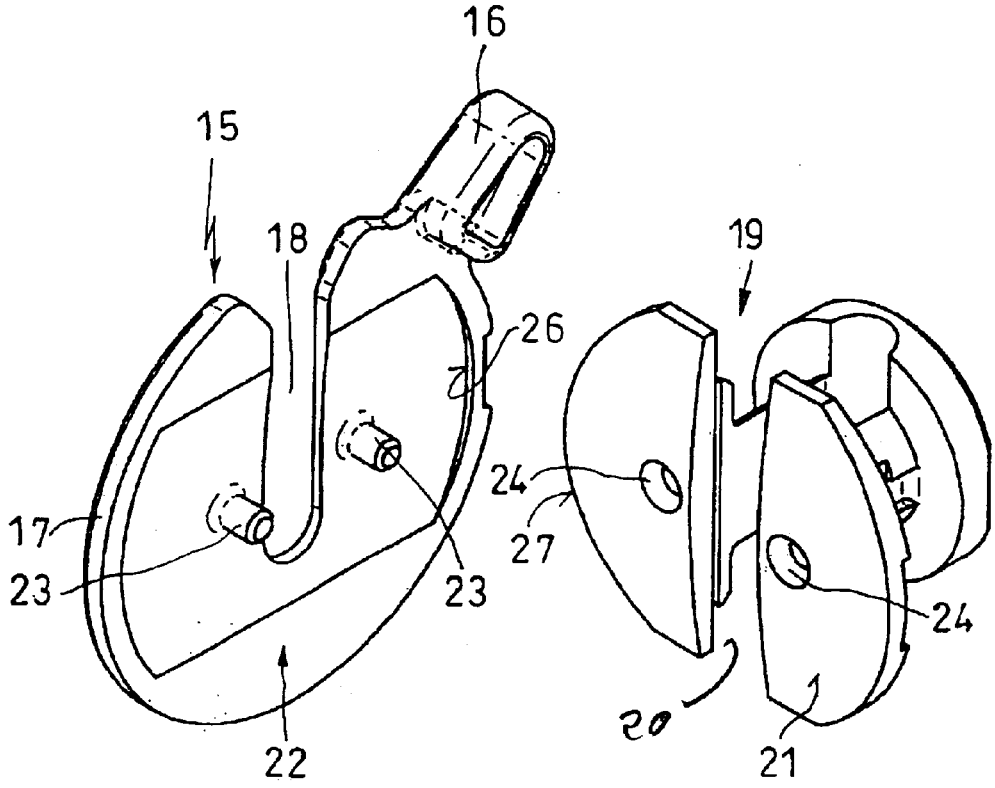
FIG. 5 is a perspective view of elements of the socket according to the invention.

In accordance with the invention an operating part 15 is fitted to the rotor. It comprises a disk 17 formed with a slot 18 alignable with the slot 20 of the rotor and an arm 16 projecting radially from the disk 17 and in fact projecting radially outward past the body 29 of the socket 10. In addition the disk 17 as shown in FIG. 5 is formed with a pair of tubular pins 23 projecting axially from a back face 22 of the disk 17 and engageable complementarily in the holes 24 so as to rotationally couple the disk 17 to the rotor 19 with the slots 18 and 20 axially aligned. These tubular pins 23 form throughgoing holes 25 that allow a test probe to pass through the part 15 and engage the contacts 28.

In addition the back face 22 of the disk 17 and the front face 21 of the rotor have complementary formations 26 and 27 that fit together to further rotationally couple the part 15 to the rotor 19, and the front face 21 of the rotor 19 and back face 22 of the disk 17 can be bonded together by welding or an adhesive or welding. In fact the entire socket 10 minus the part 15 can be a standard item, the part 15 being a retrofit.

Figure 3:
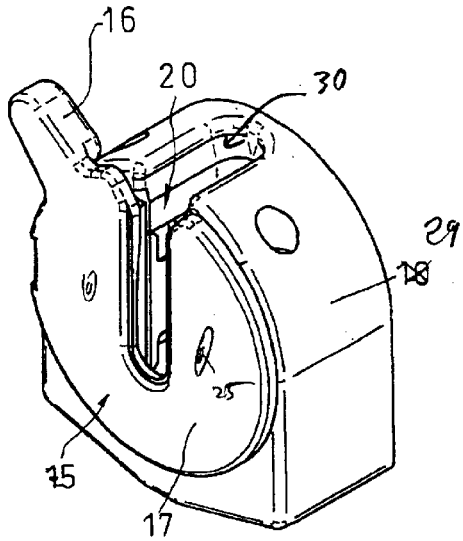

To install a new lamp L in this system the rotor socket 10 is set in the position of FIGS. 1 and 3, with the slots 18, 20, and 30 aligned. In this position a test probe can be inserted through the holes 25/24 to see if the contacts 28 are live. The pins P are slipped through the slot 30 and into the slots 18 and 20 at both ends. Then the user pivots the rotors 19 by means of one or both of the arms 16 through about 90° until the pins P engage the contacts 28. In this closed orientation, shown in dashed lines in FIG. 1, the housing 29 closes the slot 20 and the pins P are captured.

To remove the lamp L, one or both of the arms 16 is engaged and swung back through about 90° to open the slots 18 and 20, thereby allowing the pins P to be withdrawn radially.

We claim:

1. A socket for a bipin lamp, the socket comprising:

a relatively stationary body having an axis;

a pair of contacts in the body symmetrically flanking the axis;

a rotor formed with an axially open and generally diametrally extending slot and pivotal on the body about the axis between an outwardly open position and a crosswise position, pins of the lamp being insertable into the slot and being engageable with the contacts in the crosswise position; and a part having a disk fixed to the rotor and formed with a slot aligned axially with the rotor slot, and an arm fixed on and projecting radially from the disk past the lamp when the pins are in the slots, whereby a user can fit the lamp pins to the slots and pivot the rotor between the positions by means of the arm to engage the pins with the contacts.

2. The bipin lamp socket defined in claim 1, further comprising axially extending complementary formations on the faces rotationally fixing the disk to the rotor.

3. The bipin lamp socket defined in claim 1 wherein the arm projects radially past the socket body.

4. The bipin lamp socket defined in claim 1 wherein the disk and rotor have axially interengaging complementary formations that couple them together for joint rotation about the axis.

5. The bipin lamp socket defined in claim 4 wherein the formations include a pair of outwardly open holes formed in the rotor and flanking the rotor slot and a pair of axially extending pins formed on the disk flanking the rotor disk and fittable in the rotor holes.

6. The bipin lamp socket defined in claim 5 wherein the rotor holes are aligned with the contacts, whereby a test probe can be inserted through the rotor holes.

7. The bipin lamp socket defined in claim 1 wherein the rotor has an axially outwardly directed face and the disk has an axially inwardly directed face.

8. The bipin lamp socket defined in claim 7 wherein the disk face is bonded to the rotor face.

* * * * *